United States Patent [19]

Hattori et al.

[11] Patent Number: 4,990,027

[45] Date of Patent: Feb. 5, 1991

[54] SHIELD TUNNELING METHOD AND SHIELD MACHINE THEREFOR

[75] Inventors: Masato Hattori, Higashimurayama; Rihei Nukushina, Tokyo; Akira Kamide, Higashi Osaka, all of Japan

[73] Assignee: Kubota Construction Co., Ltd., Japan

[21] Appl. No.: 486,392

[22] Filed: Feb. 28, 1990

[30] Foreign Application Priority Data

Jun. 16, 1989 [JP] Japan ..... 1-152092

[51] Int. Cl.[5] ..... E21D 11/08; E21D 11/10

[52] U.S. Cl. ..... 405/146; 405/147

[58] Field of Search ..... 405/141, 143, 145, 146, 405/147, 150, 151; 299/31-33

[56] References Cited

U.S. PATENT DOCUMENTS

| | | | |
|---|---|---|---|
| 3,550,382 | 12/1970 | Khodosh et al. | 405/146 X |
| 3,561,223 | 2/1971 | Tabor | 405/147 X |
| 4,072,021 | 2/1978 | Yamazaki | 405/146 |
| 4,118,938 | 10/1978 | Unger et al. | 403/146 X |

FOREIGN PATENT DOCUMENTS

| | | |
|---|---|---|
| 1276618 | 6/1972 | United Kingdom . |
| 1288393 | 9/1972 | United Kingdom . |
| 1288394 | 9/1972 | United Kingdom . |

*Primary Examiner*—David H. Corbin

*Attorney, Agent, or Firm*—Stevens, Davis, Miller & Mosher

[57] ABSTRACT

A small diameter shield tunnel is constructed by using a shield machine and assembling within a tail portion of the machine a set of three 120° arcuate segments into a segment ring. An annular seal device is axially movably provided between the outer periphery of the segment ring and the inner periphery of a tail skin plate defining the tail portion of the machine. A back-filling material is charged into an annular gap formed between the outer peripheral surface of the segment ring and natural soil surrounding the segment ring. The back-filling material within the annular gap is compressed by the seal device which is caused to move between the inner peripheral surface of the tail skin plate and the outer peripheral surface of the segment ring, in the axial direction of the tunnel, away from a face where excavation of natural soil is carried out mechanically.

11 Claims, 13 Drawing Sheets

SHIELD TUNNELING METHOD AND SHIELD MACHINE THEREFOR

BACKGROUND OF THE INVENTION

1. Field of the Invention

The present invention relates to a shield tunneling method for constructing a small diameter tunnel with an inside diameter which is typically on the order of 1.5 m or less, by assembling a set of three 120° arcuate segments into a so-called segment ring. The present invention also pertains to a shield machine for carrying out the method.

2. Statement of the Related Art

For constructing a small diameter tunnel with an inside diameter on the order of 1.5 m or less, it is known to use a shield machine for either manually or mechanically excavating the ground face in front of the shield machine, substantially under unpressurized condition, to assemble within the shield machine a set of three 120° arcuate segments into a so-called segment ring, and to connect back-filling pipes with grout holes extending through the wall of the segments for charging a back-filling material, e.g. rounded gravels, grout or the like, into a so-called tail void which is an annular gap defined between the outer periphery of the segment ring and the surrounding soil. In this connection, reference may be had to U.K. Patent Specification Nos. 1,276,618; 1,288,393 and 1,288,394.

In the case of a shield tunneling method using the 120° arcuate segments as mentioned above, in order to allow an assembly within the shield machine of a set of segments into a segment ring, it is necessary for the radial dimension of the tail void to be at least about one half of the thickness of the segment, and to be typically as large as the segment thickness. Then, unlike in a conventional method wherein a segment ring is formed of four or more segments, it is of particular importance to uniformly charge the back-filling material into the tail void, and to achieve a sufficient hardening of the charged material therein.

When the shield tunneling method is carried out in a poor ground, it is generally necessary to remove the underground water around the face in order to prevent collapse of the face. To this end, it is a conventional practice to take various auxiliary measures together, such as chemical grouting method, pneumatic method, dewatering method or the like, either of which calls for complicated works thereby leading to a prolonged working period and a resultant increase in the working cost.

In a conventional shield tunneling method, particularly when the work is to be conducted in the poor ground, an earth pressure balancing method is sometimes used together wherein mud making agents are supplied to the face to balance the resulting force with the pressure applied to the face. The earth pressure balancing method is often advantageous in that, as compared with the above-mentioned auxiliary measures, it is far economical and yet allows the required work to be performed in a facilitated manner. However, it has been generally considered difficult to apply the earth pressure balancing method in combination with the small-diameter shield tunneling method using the 120° arcuate segments. This difficulty is closely related to the unique arrangement inherent to the small-diameter shield tunneling method wherein the tail void has a substantial radial dimension. That is, after the back-filling material has been charged into the tail void, the back-filling material often exhibits a problematic tendency to collapse prior to completion of its hardening, which is mainly due to a substantial amount of mud making agent with a high water content, and which more or less results in that the required grouting function of the back-filling material cannot be sufficiently achieved.

SUMMARY OF THE INVENTION

Consequently, it is an object of the present invention to provide a shield tunneling method and a shield machine, which can be carried out or used in combination with the earth pressure balancing system and which, even then, make it possible to stably hold the back-filling material charged into the tail void until it is hardened, thereby allowing the back-filling material to exhibit a desired satisfactory grouting function.

According to one aspect of the present invention, there is provided a shield machine for use in a shield tunneling method for constructing a small-diameter tunnel, wherein a set of three 120° arcuate segments are assembled into a segment ring within a tail portion of the shield machine defined by a tail skin plate thereof, and a back-filling material is charged into an annular gap formed between the outer periphery of the segment ring and natural soil surrounding the segment ring, said shield machine comprising: means for charging the back-filling material into said annular gap; an annular seal device to be arranged between the inner periphery of the tail skin plate and the outer periphery of the segment ring, adapted to slidably move in the axial direction of the tunnel toward and away from a face where excavation of soil is to be carried out; and an actuator adapted to cause said seal device to move in the axial direction away from the face, between the inner periphery of the tail skin plate and the outer periphery of the segment ring, after the back-filling material has been charged into said annular gap, thereby to compress said back-filling material.

According to another aspect of the present invention, there is provided a s all diameter shield tunneling method using a set of three 120° arcuate segments to be assembled into a segment ring, comprising the repeated steps of: providing a shield machine with a tail portion defined by a tail skin plate; introducing into the tail portion of said shield machine a set of three 120° arcuate segments, and assembling within said tail portion said three segments to form a segment ring; charging a back-filling material into an annular gap between the outer peripheral surface of said segment ring and natural soil surrounding the segment ring; providing an annular seal device between the outer periphery of said segment ring and the inner periphery of said tail skin plate, said seal device being adapted to slidably move in the axial direction of the tunnel toward and away from a face where excavation of soil is to be carried out; and causing the annular seal device of said shield machine to move between the inner peripheral surface of said tail skin plate and the outer peripheral surface of said segment ring, in the axial direction of the tunnel away from said face, thereby to compress the back-filling material in said annular gap.

With the above-mentioned arrangement and process steps of the present invention, the back-filling material charged into the annular gap between the outer periphery of the segment ring and surrounding soil can be sufficiently compressed by the seal device which can be moved axially within the annular gap, enabling formation of a layer of uniform, fine and high strength back-filling material over the entire outer periphery of the segment ring, even under a high water content in a poor ground. It thus becomes possible to effectively and positively prevent undesired collapse of the back-filling material layer prior to the completion of its hardening, even under penetration of an excessive amount of water from the ground. Consequently, the earth pressure balance type shield tunneling method can be applied in combination with the small diameter shield work using a set of three 120° arcuate segments to economically construct a desired small diameter tunnel.

DETAILED EXPLANATION OF THE PREFERRED EMBODIMENTS

Figure 1:
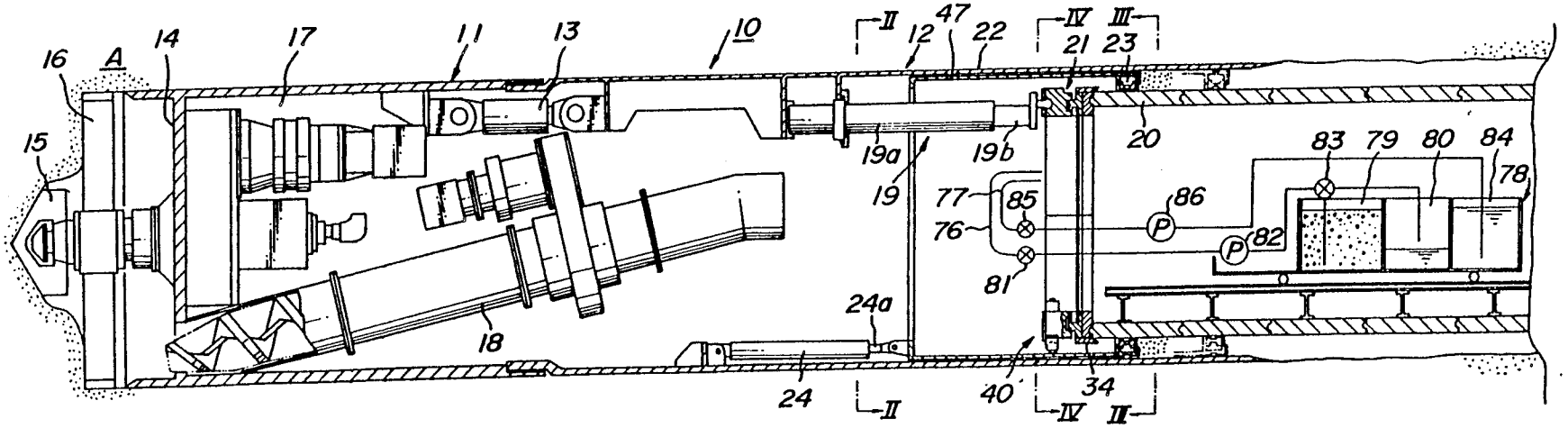
FIG. 1 is a longitudinal-sectional view showing a shield machine in accordance with one embodiment of the present invention.
Figure 2:
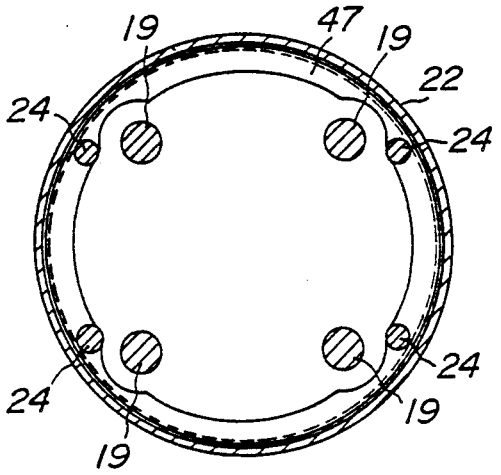
FIG. 2 is a cross-sectional view taken along the line II—II of FIG 1.
Figure 3:
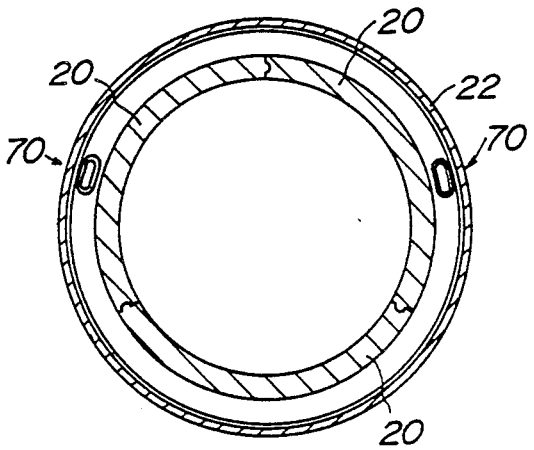
FIG. 3 is a cross sectional view taken along the line III—III of FIG. 1.

The present invention will now be explained in further detail by referring to some specific embodiments shown in the accompanying drawings. There is shown in FIGS. 1 to 4 a shield machine 10 according to a preferred embodiment of the present invention. The shield machine 10 makes use of an earth pressure balancing system, wherein the soil is mechanically excavated at the face while the face pressure and the pressure of the muck are balanced with each other. The shield machine 10 comprises a front portion 11 and a rear portion 12 each having a cylindrical form. The two portions 11 and 12 are connected with each other in an articulated manner, by means of a plurality of jacks 13 for adjusting their mutual orientation.

The front portion 11 of the shield machine 10 adjacent to its front end is provided with a bulkhead 14, and a cutter 15 and a copy cutter 16 for mechanically excavating the natural ground A at the face, each attached to the bulkhead 14, as well as a drive motor 17 for driving the cutters 15 and 16. Further disposed at the front portion 11 is screw conveyer 18, which serves to discharge muck during the excavation by the cutters 15 and 16. The conveyer 18 extends through the bulkhead 14 such that its front end for receiving the muck protrudes into a space between the rear surface of the cutter 15 and the front surface of the bulkhead 14.

The rear portion 12 of the shield machine has a space allowing various works to be performed therein, including an assembly of a set of three 120° arcuate segments into a segment ring 20. There are arranged a plurality of shield jacks 19 having cylinders **19*a* fixed to the inner periphery of a tail skin plate, and rods 19*b* secured to a press ring 21 for applying a thrust to the end surface of the segment ring 20. The rear portion 12 is further provided, in addition to the above-mentioned tail skin plate 22, with an annular seal device 23 slidably disposed within a so-called tail void, which is an annular gap between the inner periphery of the tail skin plate 22 and the outer periphery of the segment ring 20, as well as an actuator 24 which, after the back-filling material has been charged into the tail void serves to compresses the back-filling material by causing the seal device 23** to slide axially away from the face.

Figures 5, 6:
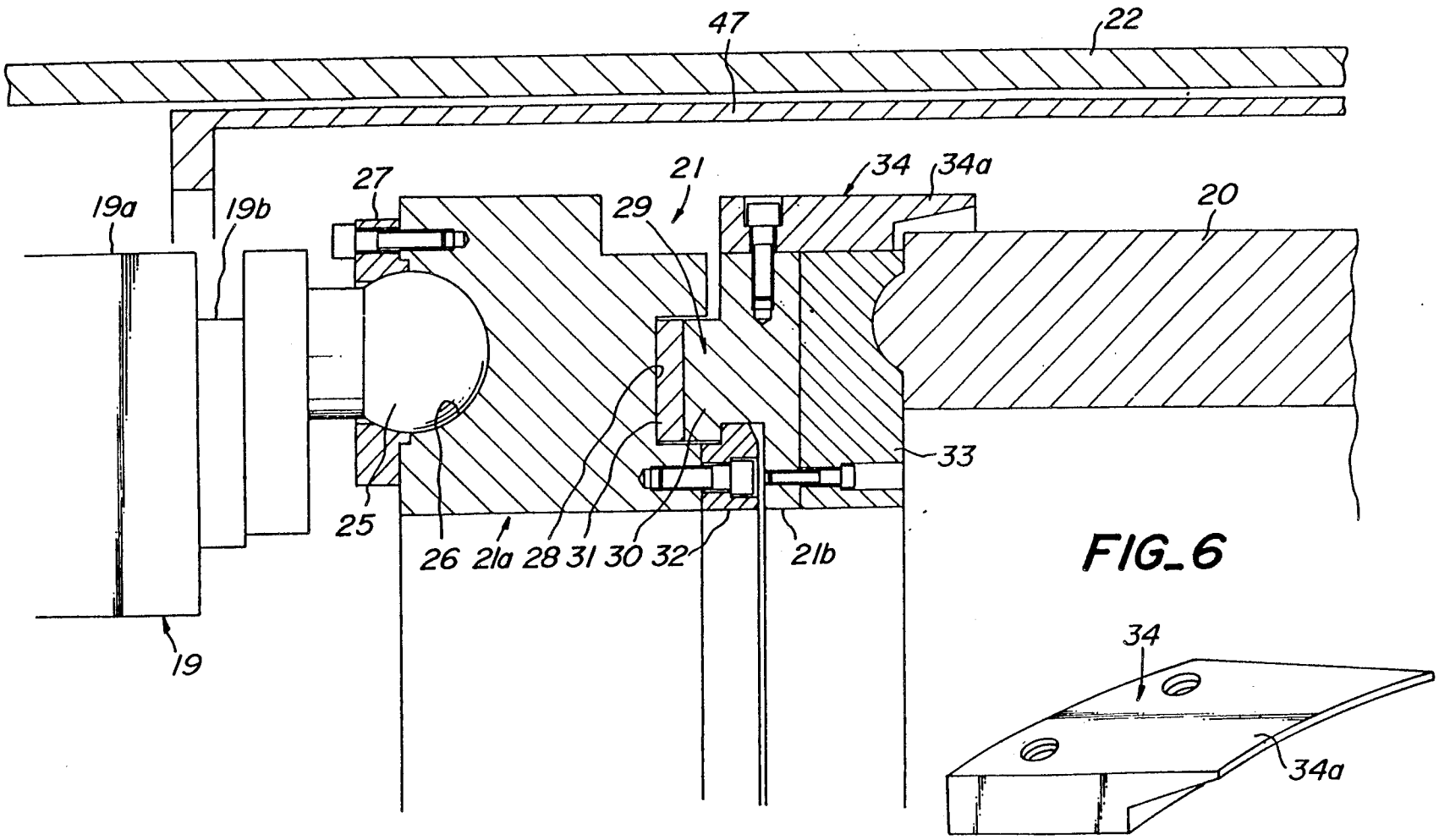
FIG. 5 is a partial longitudinal-sectional view showing a detailed arrangement of the press ring provided in the shield machine.
FIG. 6 is a perspective view showing a gang fitting provided at the press ring.

The press ring 21 is connected to the rods **19*b* of the shield jacks 19 so that an axial thrust is applied thereto through the rod 19*b*, in a manner known per se. In order that the thrust can be properly transmitted from the shield jack 19 to the press ring 21, as shown in FIG. 5, a spherical convex portion 25 is formed at the tip end of each rod 19*b*, while a spherical concave portion 26 corresponding to the convex portion 25 is formed at the end surface of the press ring 21. The convex portions 25 are fitted into the respective concave portions 26, so that even when the longitudinal axes of the rods 19*b* are not exactly in parallel with the longitudinal axis of the press ring 21 for some reason or others, only the axial thrust can be transmitted from the rods 19*b* to the press ring 21. A retainer ring 27 is secured to the end surface of the press ring 21 in order to prevent disengagement of the convex portions 25 from the concave portions 26**, and maintain them in engagement with each other.

The pres ring 21 is composed of a pair of ring members **21*a* on the side of the shield jack 19, and a rear ring member 21*b* on the side of the segment ring 20. The opposed end surfaces of the ring members 21*a* and 21*b* are provided with a concave portion 28 and a convex portion 29, respectively, which are in abutment with each other with an annular thrust bearing member 30 arranged therebetween, such that the ring members 21*a*, 21*b* can be relatively rotated. A retainer ring 32 is secured to the end surface of the front ring member 21*a*, and is brought into engagement with the rear ring member 21*b* behind the convex portion 29, whereby the ring members 21*a* and 21*b*** are prevented from undesired relative axial movement.

A buffer ring 33 made of an appropriate material such as rubber, plastic or the like, often called as a "timber ring", is threadedly connected with the rear end surface of the rear ring member 21*b* as being opposed to the segment ring 20. The buffer ring 33 is subjected to a compression deformation when acted upon the axial thrust, such that the thrust can be uniformly applied to and distributed along the entire end surface of the segment ring 20 on its face side, thereby to prevent an undesired local stress concentration on the end surface of the segment ring 20, and to positively protect the segment ring 20 from damages.

Figure 4:
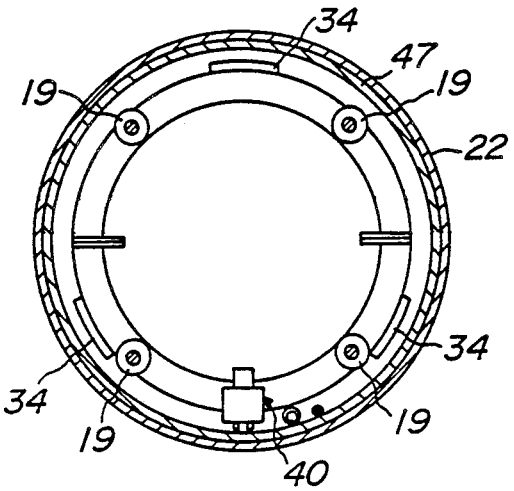
FIG. 4, is a cross-sectional view taken along the line IV—IV of FIG. 1.

In order to achieve an exact alignment of the segment ring 20 with reference to the press ring 21, as shown in FIG. 5, a plurality of gang fittings 34 are threadedly connected onto the outer periphery of the rear ring members 21*b* so as to protrude toward and beyond the tip end portion of the segment ring 20. Each fitting 34 is provided with a tapered inner periphery 34*a* which may serve as a guide surface of the segment ring 20 (FIG. 6). That is, when the press ring 21 is urged against the end surface of the segment ring 20, each gang fittings 34 engages with the segment ring 20 along its inner periphery 34a to guide the movement of the press ring 21 toward the segment ring 20 into a proper position where their axes are in exact alignment with each other. Preferably, as shown in FIG. 4, a set of three gang fittings 34 are disposed at an equiangular distance of 120°.

Figure 7:
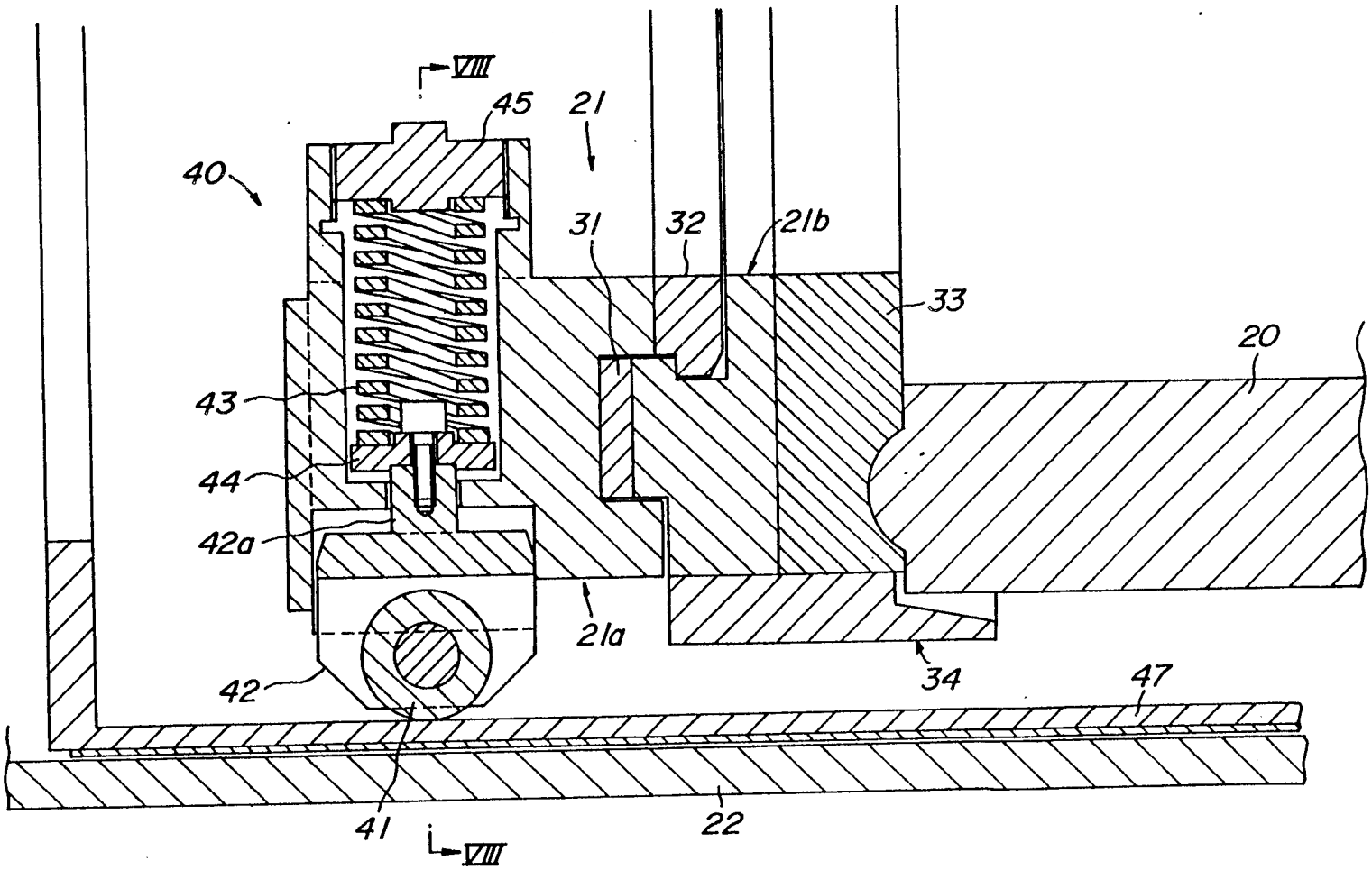
FIG. 7 is a longitudinal-sectional view showing a support roller assembly provided at the press ring.
Figure 8:
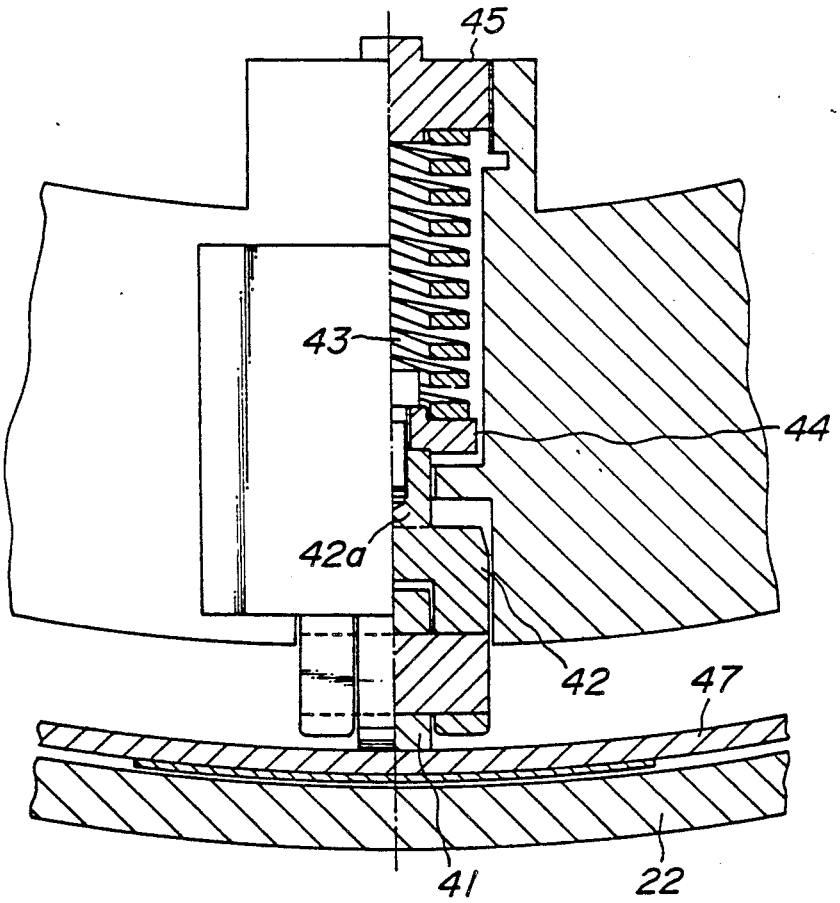
FIG. 8 is a longitudinal-sectional view taken along the line VIII—VIII of FIG. 7.
Figure 9:
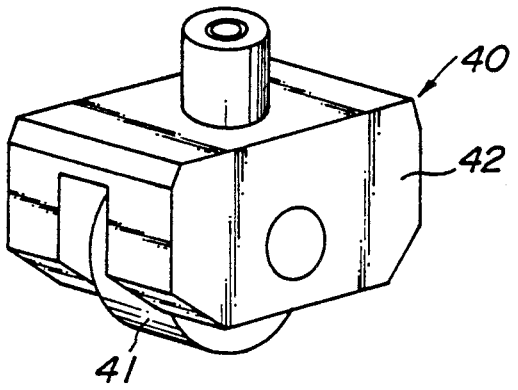
FIG. 9 is a perspective view showing the support roller assembly.

Furthermore, in order to achieve an alignment of the press ring 21 itself with reference to the shield machine 10, as shown in FIGS. 7 to 9, the press ring 21 at its lower end portion may be provided with at least one support roller assembly 40. The assembly 40 includes a roller 41 adapted to roll along the inner surface of the tail skin plate 22, a bracket 42 for rotatably supporting the roller 41, and a compression coil spring 43 which urges the bracket 42 toward the inner surface of the tail skin plate 22. The coil spring 43 has its lower end in engagement with a metal seat member 44, which is connected with a projection 42*a* formed on the upper end portion of the bracket 42, and its upper end in engagement with an adjusting bolt 45. It is of course that, by adjusting the axial position of the bolt 45, the force of the spring 43 acting on the bracket 42 can be adjusted so as to balance the dead weight of the press ring 21 and the force of the spring 43, to vertically position the press ring 21 at a location where its longitudinal axis is in exact alignment with that of the shield machine 10.

A specific arrangement of the seal device 23, which is disposed between the inner periphery of the tail skin plate 22 and the outer periphery of the segment ring 20, will be described hereinafter, with reference to the embodiments shown in FIGS. 10 to 13.

Figure 10:
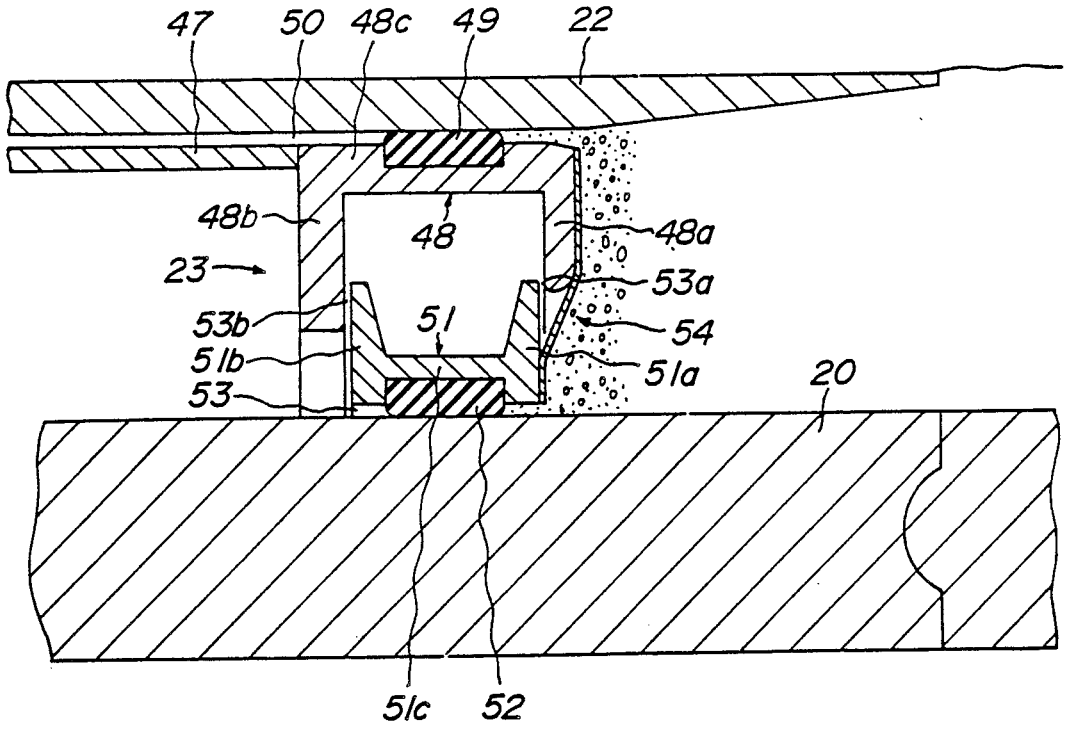
FIG. 10 is a longitudinal-sectional view showing one embodiment of an annular seal device provided in the shield machine.

First of all, in the embodiment shown in FIG. 10, the seal device 23 is disposed at the free end of an inner cylinder 47 which extends along the inner periphery of the tail skin plate 22, and which is connected to the actuator 24. Thus, as the actuator 24 is actuated, the seal device 23 is moved axially rearwardly along the inner periphery of the tail skin plate 22, to compress the back-filling material charged into the tail void in a manner to be described below.

In this embodiment, an outer retainer member 48 is provided as an integral extension at the free end of the inner cylinder 47. The retainer member 48 includes a pair of end walls 48*a*, 48*b* extending radially inwardly, as well as a peripheral wall 48*c* connecting the end walls 48*a*, 48*b* with each other. Each end walls 48*a*, 48*b* of the outer retainer member 48 has an inner diameter which is slightly greater than the outer diameter of the segment ring 20. A seal ring 49 forming an outer seal member is disposed between the outer periphery of the peripheral wall 48*c* and the inner periphery of the tail skin plate 22. The seal ring 49 serves to seal a gap 50 between the retainer member 48 and the tail skin plate 22. The end walls 48*a*, 48*b* and the peripheral wall 48*c* of the outer retainer member 48 define a space which is made to open toward the outer periphery of the segment ring 20 for accommodating therein an inner retainer member 51. The inner retainer member 51 includes a pair of end walls 51*a*, 51*b* extending radially outwardly, as well as a peripheral wall 51*c* connecting the end walls 51*a*, 51*b* with each other. Each end walls 51*a*, 51*b* of the inner retainer member 51 has an outer diameter which is slightly smaller than the inner diameter of the peripheral wall 48*c* of the outer retainer member 48, e.g. by about 20 mm. A seal ring 52 forming an annular inside seal member is disposed between the inner periphery of the peripheral wall 51*c* and the outer periphery of the segment ring 20 to seal a gap 53 between the peripheral wall 51*c* and the segment ring 20. The outer and inner seal rings 49, 52 are brought into a surface contact with the tail skin plate 22 and the segment ring 20, respectively, over a sufficient axial length.

The radial size of the gap between the inner periphery of the tail skin plate 22 and the outer periphery of the segment ring 20 is not necessarily constant in the circumferential direction. The abovementioned arrangement of the outer and inner retainer rings 48, 51 in the embodiment shown in FIG. 10 ensures that the inner retainer member 51 can be relatively displaced in the radial direction with reference to the outer retainer member 48, in an eccentric manner, to compensate for possible change in the radial size of the gap as seen in the circumferential direction.

When the outer retainer member 48 and the inner retainer member 51 are arranged to be relatively displaced in the radial direction, as mentioned above, the end walls 48*a*, 48*b* are preferably in slide contact with the end walls 51*a*, 51*b*, respectively. Then, in order to eliminate possible degradation of the sealing property, which may be caused by slight gaps 53*a*, 53*b* along the slide contact portion, an intermediate seal member 54 composed of a resilient sheet member is preferably provided to seal at least the gap 53*a* on the compression side extending in the direction in which the back-filling material charged into the tail void is compressed. The intermediate seal member 54 includes an outer periphery which is fixed to the end surface of the end wall 48*a* on the compression side of the outer retainer member 48, and an inner periphery which is fixed to the end surface of the end wall 51*a* on the compression side of the inner retainer member 51. The intermediate seal member 54 can thus be deformed following the radial displacement of the inner retainer member 51.

The above-described annular seal device 23 having the outer seal member 49, the inner seal member 52 and the intermediate seal member 54 achieves a satisfactory sealing performance between the shield machine 10 and the tail void charged with the back-filling material, effectively and reliably preventing intrusion or leakage of water from the tail void into the shield machine.

Figure 11:
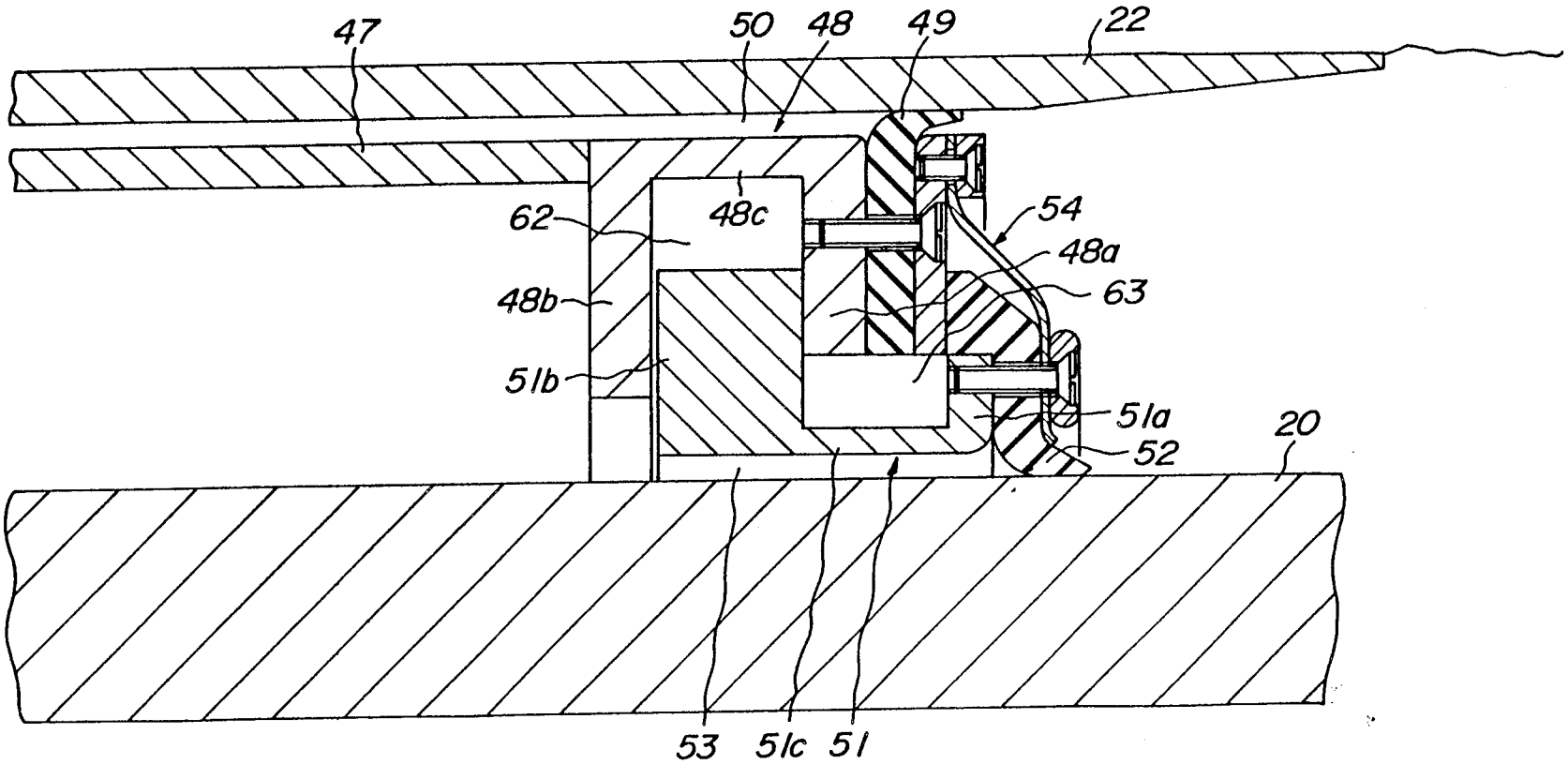
FIG. 11 is a longitudinal-sectional view showing another embodiment of the annular seal device.

There is shown in FIG. 11 another example of the seal device 23. The seal device according to this example is basically the same in its arrangement as the previous one, so that corresponding elements are denoted by the same reference numerals. The seal device 23 according to the present example includes outer and inner retainer members 48, 51 respectively disposed at the free end of the inner cylinder 47 which, in turn, is connected to the actuator 24. The outer and inner retainer members 48, 51 are provided with seal members in the form of seal lips 49, 52, respectively. The seal lip 49 provided for the outer retainer member 48 is threadedly connected with the end wall 48*a* of the retainer member 48, at the proximal end on the inner periphery side thereof, and is in seal contact with the inner periphery of the tail skin plate 22 at its lip section on the outer periphery side. Similarly, the seal lip 52 provided for the inner retainer member 51 at the inner side is threadedly connected with the end wall 51*a* of the retainer member 51 at the proximal end on the outer periphery side thereof, and is in seal contact with the outer periphery of the segment ring 20 at its lip section on the inner periphery side.

Figure 12:
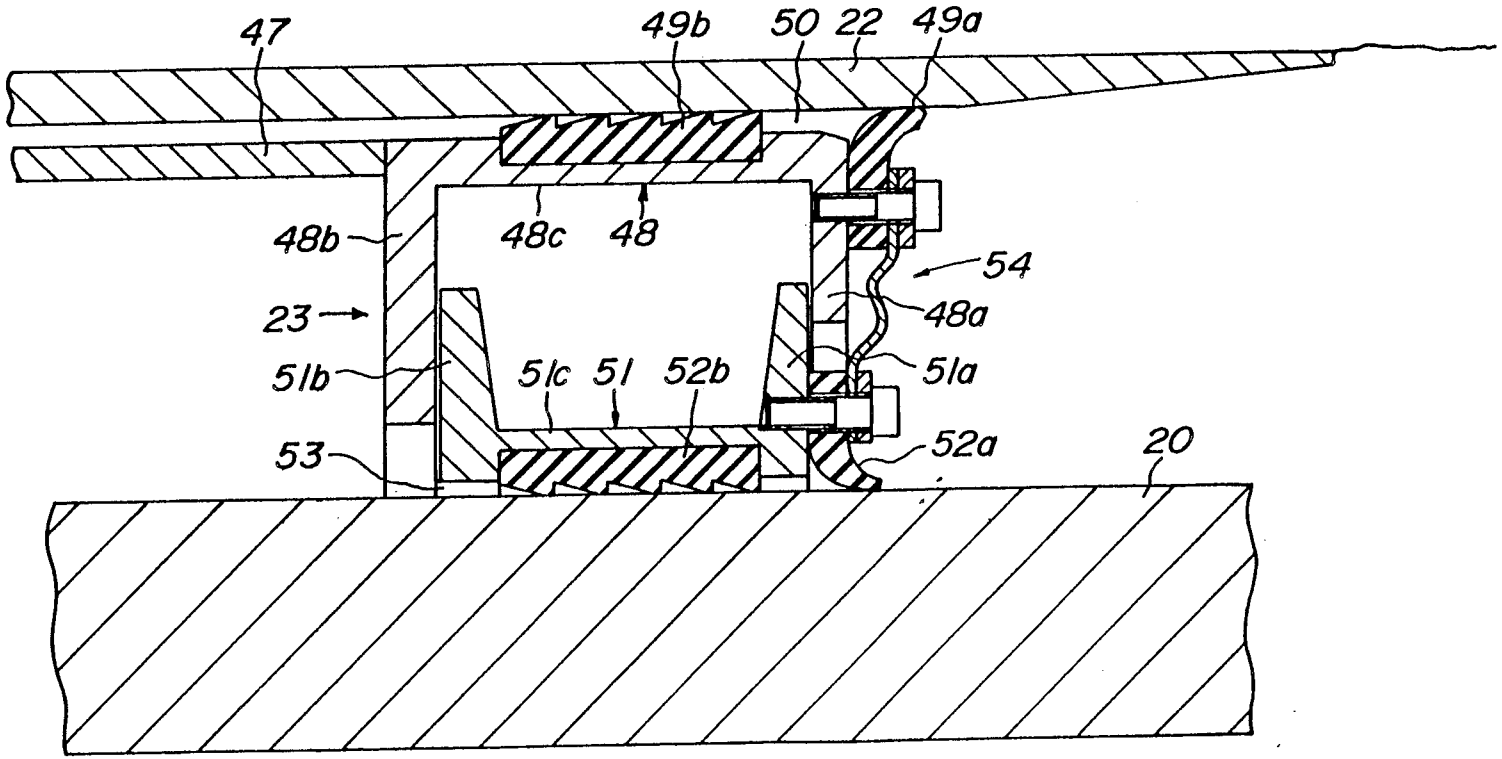
FIG. 12 is a longitudinal-sectional view showing still another embodiment of the annular seal device.

FIG. 12 illustrates still another example of the seal device 23. The seal device 23 of this example has an arrangement which combines the structures explained above with reference to FIGS. 10 and 11, so that corresponding elements are denoted by the same reference numerals. The seal device 23 of this example also has outer and inner retainer members 48, 51 respectively disposed at the free end of the inner cylinder 47 which, in turn, is connected to the actuator 24. The seal member provided for the outer retainer member 48 is composed of a seal lip 49*a* attached to the end wall 48*a*, and a seal ring 49*b* attached to the peripheral wall 48*c*. The seal ring 49*b* may have a saw-toothed cross-section on its outer periphery, so as to be in line contact with the inner periphery of the tail skin plate 22. Similarly, the seal member provided for the inner retainer member 51 is composed of a seal lip 52*a* attached to the end wall 51*a*, and a seal ring 52*b* attached to the peripheral wall 51*c*. The seal ring 52*b* also may have a saw-toothed cross-section on its inner periphery, so as to be in line contact with the outer periphery of the segment ring 20. In this case, since each of the outer and inner seal members has a combination of the seal lip and seal ring, a dual seal arrangement is formed along the inner periphery of the tail skin plate 22 and the outer periphery of the segment ring 20, with the result that an even more reliable seal performance can be achieved between the tail void and the shield machine 10.

Figure 13:
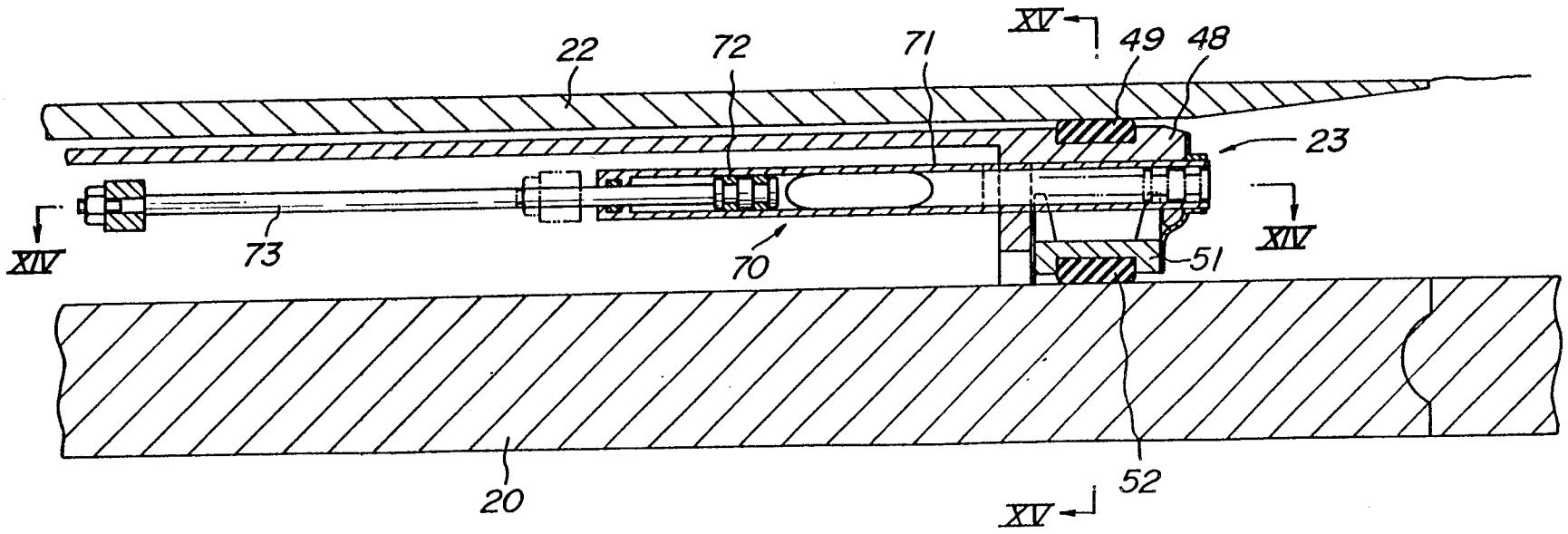
FIG. 13 is a longitudinal-sectional view showing a device for charging the back-filling material, which is provided at the shield machine.
Figure 14:
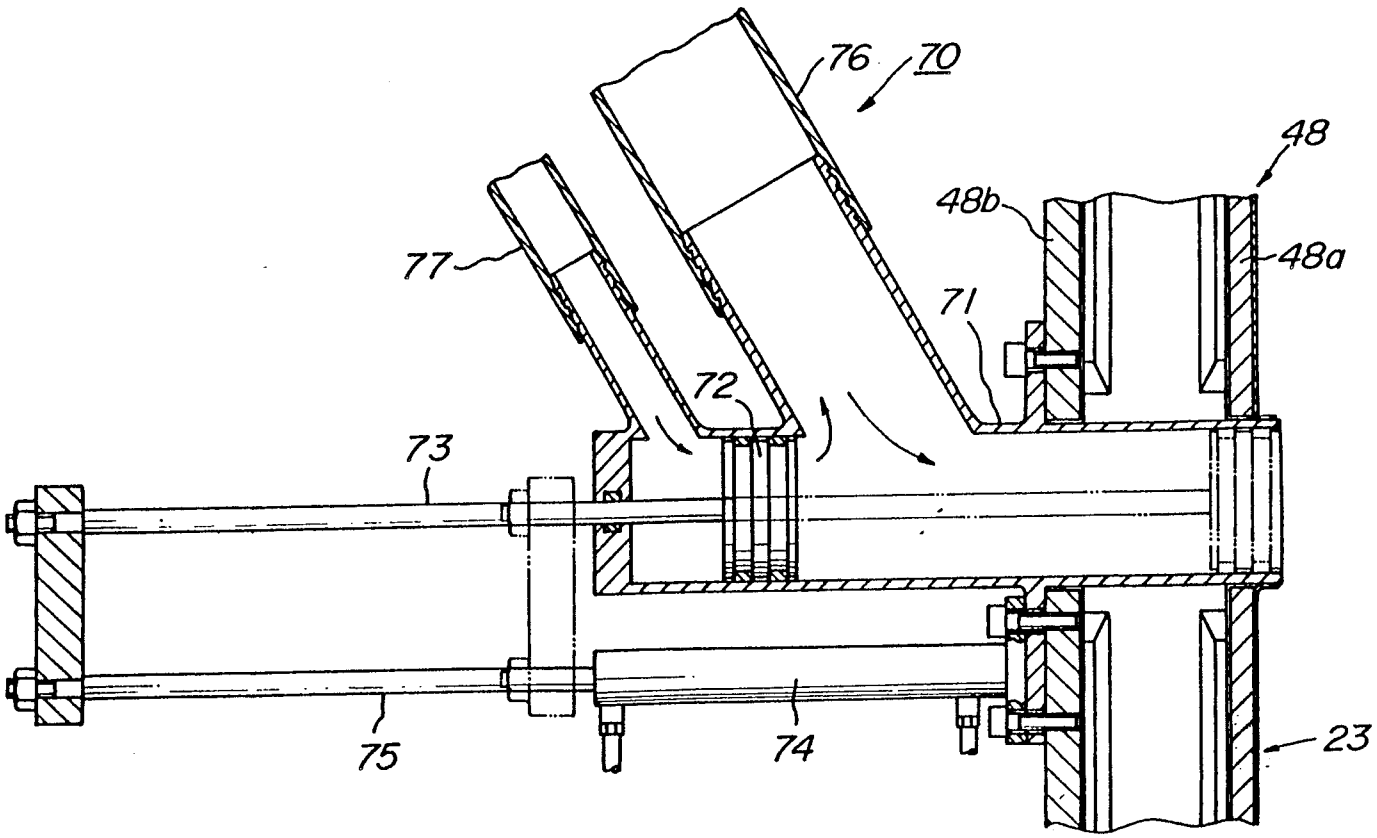
FIG. 14 is a longitudinal-sectional view taken along the line XIV—XIV of FIG. 13.
Figure 15:
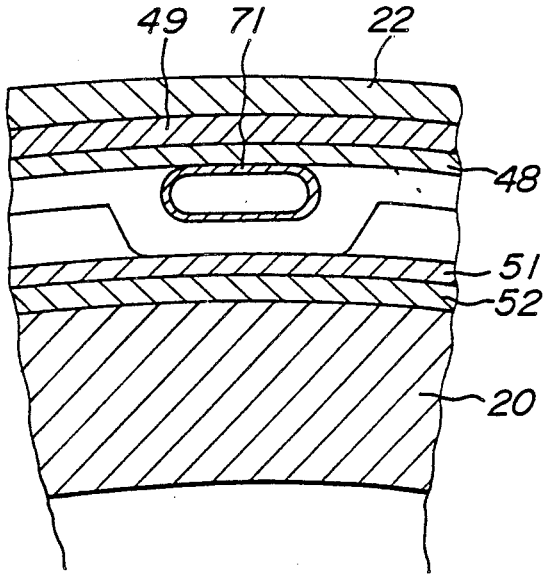
FIG. 15 is a cross-sectional view taken along the line XV—XV of FIG. 13.

There is shown in FIGS. 13 to 15 one example of the device for charging the back-filling material into the tail void. The charging device of this example, designated as a whole by reference numeral 70, is arranged in combination with the above-mentioned seal device 23 and includes a cylinder 71 fixedly connected to the outer retainer member 48 axially through the seal device 23. A piston 72 is slidably arranged within the cylinder 71 and connected to a rod 73 which is axially reciprocably driven by an actuator 74 through its output rod 75. The cylinder 71 extends from the end wall 48*b* of the retainer member 48 toward the face, and has its cylinder bore opening end which may slightly project from the end wall 48*a* into the tail void. Connected to the cylinder 71 are a supply pipe 76 for charging the back-filling material into the tail void, and an injection pipe 77 for injecting flushing water into the cylinder 71 and the supply pipe 76. The supply pipe 76 is led to a carriage 78 for carrying the back-filling material (see FIG. 1), and connected to a back-filling material storage tank 79 and a water storage tank 80 on the carriage 78 through gate valve 81, pump 82 and switching valve 83. The flushing water injection pipe 77 is connected to a water supply tank 84 also mounted on the carriage 78, through gate valve 85 and pump 86. When the piston 72 within the cylinder 71 assumes a supply position indicated by solid lines in FIG. 14, the opening end of the cylinder 71 is brought into communication with the supply pipe 76, while a communication between the pipes 76 and 77 is interrupted. When, on the other hand, the piston 72 assumes a flushing position indicated by imaginary lines, the end of the cylinder 71 is closed by the piston 72 to interrupt the communication between the supply pipe 76 and the tail void, while bringing the supply pipe 76 into communication with the injection pipe 77. As shown in FIG. 15, the cylinder 71 and the piston 72 may each have a flat cross-section so as to be readily accommodated in the internal space of the seal device 23. The actuator 74 for actuating the drive rod 73 is fixedly connected to the end wall 48*b* of the outer retainer member 48 such that it is arranged in a circumferentially juxtaposed relationship with the cylinder 71. Thus, the output rod 75 of the actuator 74 and the drive rod 73 are connected to each other in a U-shaped fashion, with the result that the charging device 70 of a compact structure can be readily accommodated within a limited narrow space of the tail void.

The operation of the shield machine according to the illustrated embodiment of the present invention will be explained hereinafter in connection with each operating step of the shield works.

Figure 18:
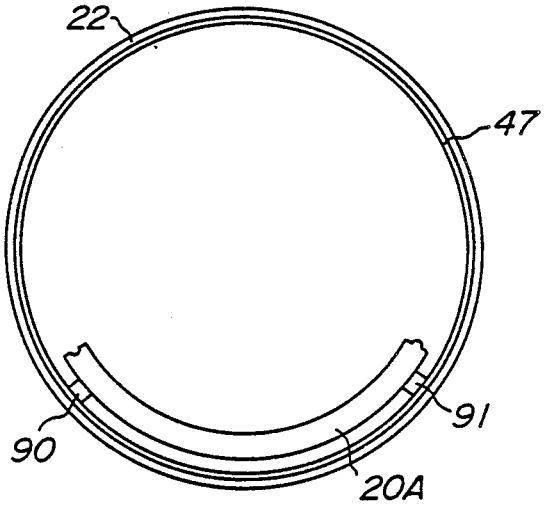
FIGS. 18 to 20 are schematic views respectively showing the procedure for assembling a set of three 120° arcuate segments.
Figure 19:
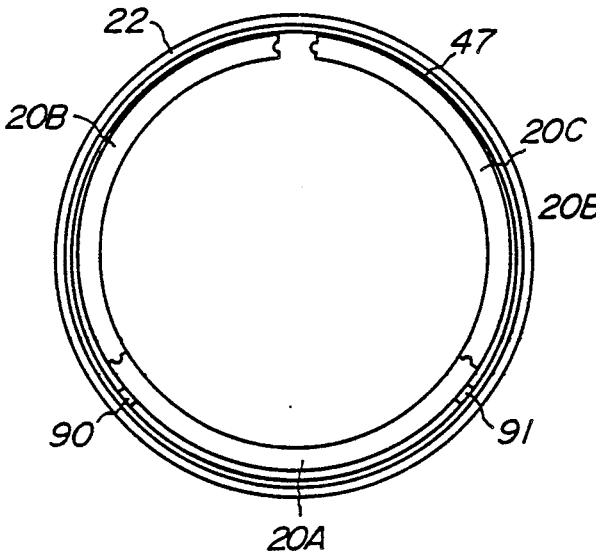
Figure 20:
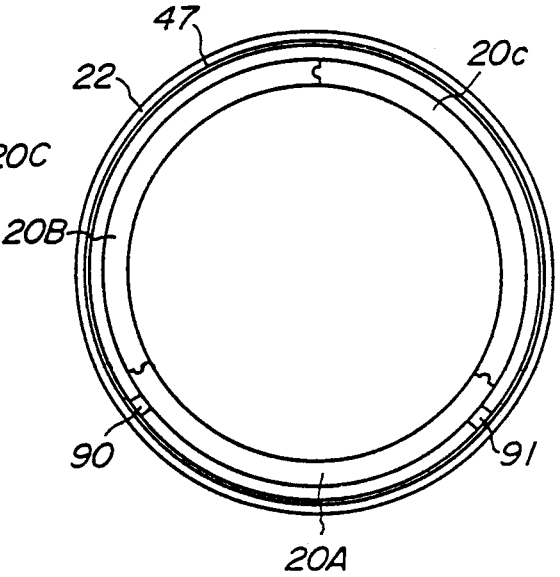

First of all, a set of three 120° arcuate segments 20A, 20B, 20C are introduced into the tail portion of the shield machine 10 and assembled therein into a unit segment ring 20. Of these segments, as shown in FIG. 18, an inverted segment 20A is placed on support members 90, 91 disposed at the bottom region of the inner cylinder 47 within the tail skin plate 22. Then, as shown in FIG. 19, each side segment 20B, 20C is brought into abutment against the inverted segment 20A in an end-to-end relationship, while tentatively retaining each upper end of the side segments 20B, 20C along the inner periphery of the inner cylinder. Subsequently, as shown in FIG. 20, the upper ends of the side segments 20B, 20C are released and brought into abutment against each other to form a complete unit segment ring 20. The detail of the assembly procedure is fully disclosed, for example, in the above-mentioned U.K. Patent Specifications.

Figure 16:
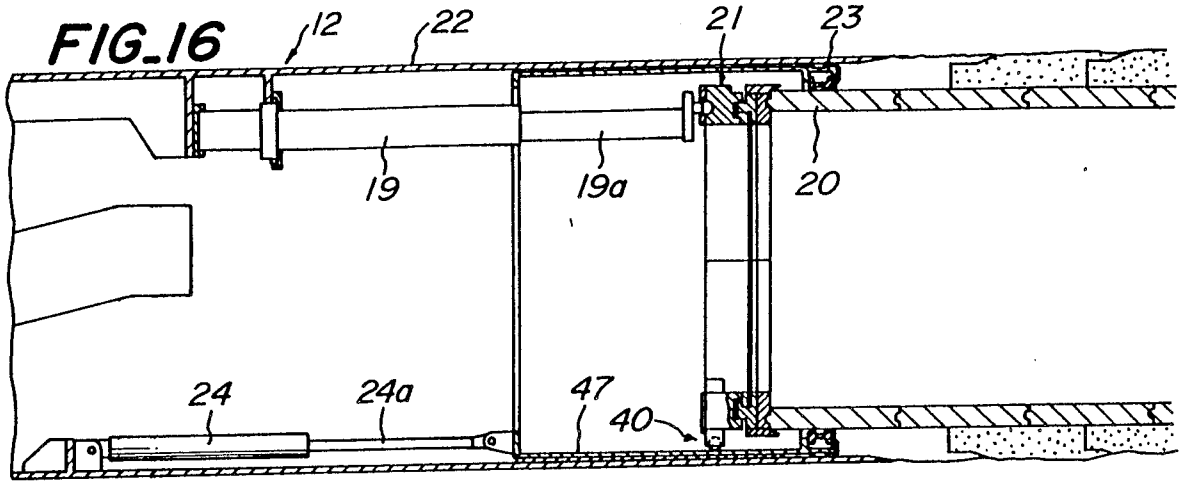
FIGS. 16 and 17 are longitudinal-sectional views respectively showing the forward and rearward positions of the press ring before and after actuation of a shield jack.
Figure 17:
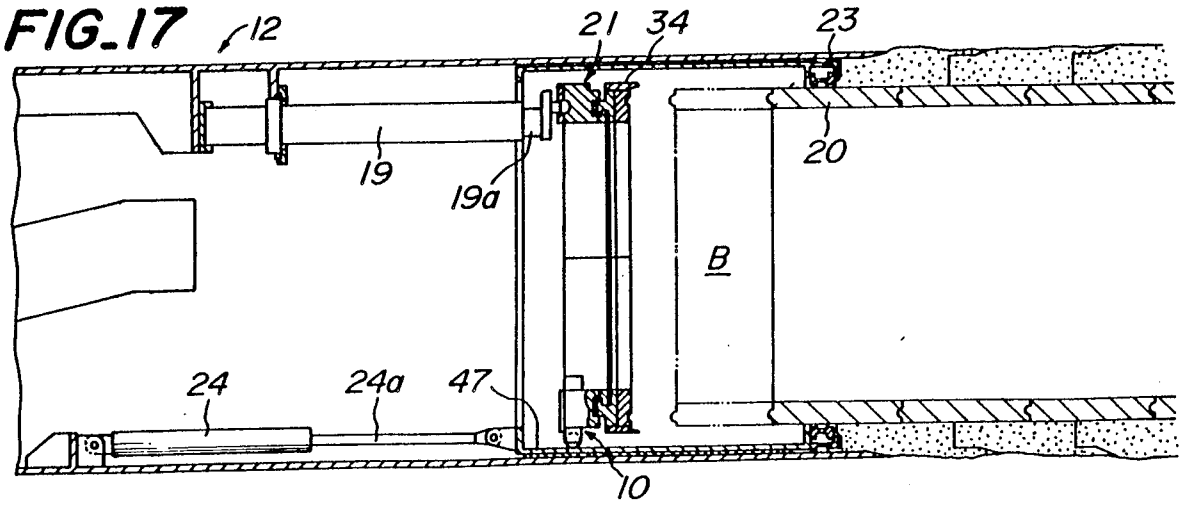

Then, a hydraulic pressure is applied to the shield jack 19, with the press ring 21 in engagement with the front end surface of the segment ring 20, as shown in FIG. 1. The rod 19*b* of the shield jack 19 is extended, as shown in FIG. 16, by a predetermined stroke corresponding t the axial length of the segment ring 20. The resultant reaction force serves to advance the shield machine 10, such that the cutters 15 and 16 at the front portion of the shield machine 10 are urged against the face to excavate the natural ground by an amount corresponding to a unit stroke of the shield machine 10, as shown in FIG. 16.

It is of course that the shield machine 10 advances together with the actuator 24, since the latter is fixedly connected to the inner periphery of the tail skin plate 22. It is therefore desirable to maintain the seal device 23 at an axially constant location relative to the segment ring 20, despite the advancement of the shield machine 10, to thereby prevent collapse of the back-filling m terial before completion of its hardening. It is for this reason that the actuator 24 is operated synchronously with the shield jack 19 to push out the rod 24*a* of the actuator toward the tail void by a stroke corresponding to an operating stroke of the shield jack 19.

Subsequently, the back-filling material is charged into the annular gap between the outer periphery of the segment ring 20 and the surrounding soil A. To this end, the actuator 24 is operated to retract the rod 24*a* to displace the seal device 23 axially toward the face relative to the segment ring 20. As a result, a space for charging a new back-filling material is formed between the seal device 23 and the back-filling material which has already been hardened. With this state, the actuator 74 is actuated to move the piston 72 up to the charging position between the supply pipe 76 and the flushing water pipe 77, as shown by solid lines in FIG. 14, to bring the supply pipe 76 into communication with the bore portion of the cylinder so that a predetermined amount of the back-filling material within the tank 79 is pressurized by the pump 82 and charged into the tail void via the supply pipe 76 and the cylinder 71.

After the back-filling material has been fully charged into the tail void, the piston 72 is moved by the actuator 74 up to the flushing position at the tip end of the cylinder 71, as shown by imaginary liens in FIG. 14, while at the same time the valve 83 included in the supply pipe 76 is switched so as to bring the cylinder 71 into communication with the water storage tank 80. The flushing water within the tank 84 is pressurized by the pump 86 and injected into the cylinder 71 via the injection pipe 77 to wash and clean the interior of the supply pipe 76. The flushing water is then discharged into the storage tank 80 via the supply pipe 76. When the flushing water is discharged over a predetermined period of time, the back-filling material left within the cylinder 71 and the supply pipe 76 is completely removed, and is thus positively prevented from solidification and adhesion to the inner wall surface.

The rod 24*a* of the actuator 24 is further extended from the position shown in FIG. 16 to press out the seal device 23 toward the tail void, in order to fully compress the back-filling material. This compression allows excessive water contained in the back-filling material to be squeezed out and absorbed into the natural soil A, effectively preventing the collapse of the back-filling material before completion of its hardening, and thereby forming a fine and minute back-filling material layer.

A desired small diameter tunnel can sequentially be built up by repeating the above-described process steps of assembling another sets of three 120° arcuate segments, advancing the shield machine 10, and charging and compressing the back-filling material.

It will be appreciated from the foregoing description that, according to the present invention, the back-filling material is charged into the annular gap between the outer periphery of the segment ring and the inner periphery of the natural soil, and is sufficiently compressed by means of the seal device which is axially movable within the gap. This makes it possible to form a uniform, fine and high strength back-filling material layer over the entire outer periphery of the segment ring even in a poor ground with a high water content, which effectively prevents the collapse of the back-filling material before completion of its hardening as a result of penetration of excessive water from the surrounding soil. Consequently, a desired small-diameter tunnel can be economically constructed by applying the earth pressure balance shield method to the small-diameter shield work using 120° arcuate segments.

While the present invention has been described with reference to certain specific embodiments, these were presented by way of examples only, and a number of variations and/or modifications may be made without departing from the scope of the invention. For example, instead of charging the back-filling material into the tail void through the annular seal device as in the above-mentioned embodiments, the back-filling material supply pipe ma be connected to a grout hole on the inner periphery of the segment in a conventional manner known per se, to charge the back-filling material into the tail void through the segment wall, provided that the seal device achieves the combined sealing and compression function for the back-filling material within the tail void.

What is claimed is:

1. A shield machine for use in a shield tunneling method for constructing a small-diameter tunnel, wherein a set of three 120° arcuate segments are assembled into a segment ring within a tail portion of the shield machine defined by a tail skin plate thereof, and a back-filling material is charged into an annular gap formed between the outer periphery of the segment ring and natural soil surrounding the segment ring, said shield machine comprising:

means for charging the back-filling material into said annular gap;

an annular seal device to be arranged between the inner periphery of the tail skin plate and the outer periphery of the segment ring, adapted to slidably move in the axial direction of the tunnel toward and away from a face where excavation of soil is to be carried out; and an actuator adapted to cause said seal device to move in the axial direction away from the face, between the inner periphery of the tail skin plate and the outer periphery of the segment ring, after the back-filling material has been charged into said annular gap, thereby to compress said back-filling material.

2. The shield machine as claimed in claim 1, wherein said seal device comprises first and second seal members which are adapted to be radially displaced relative to each other while continuously maintaining a sealing function between the inner periphery of the tail skin plate and the other periphery of the segment ring, said first seal member forming a first seal contact portion with the inner periphery of the tail skin plate, and said second seal member forming a seal second contact portion with the outer periphery of the segment ring.

3. The shield machine as claimed in claim 2, wherein said first contact portion of said first seal member with the inner periphery of the tail skin plate is formed as at least one line contact portion.

4. The shield machine as claimed in claim 2, wherein said second contact portion of said second seal member with the outer periphery of the segment ring is formed as at least one line contact portion.

5. The shield machine as claimed in claim 1, wherein said means for charging the back-filling material into said annular gap comprises a cylinder which extends from inside of the shield machine through said annular seal device to open into said annular gap, and a back-filling material supply pipe connected to said cylinder.

6. The shield machine as claimed in claim 5, wherein said cylinder has a flat cross-section with its width as measured in the circumferential direction of said annular seal device being greater than its thickness as measured in the radial direction of said annular seal device.

7. The shield machine as claimed in claim 5, further comprising a flushing water injection pipe connected to said cylinder, and a piston disposed within said cylinder and adapted to move between a first position where the back-filling material from said supply pipe can be pressed into said annular gap, and a second position where said back-filling material supply pipe is brought into communication with the flushing water injection pipe while interrupting communication between said back-filling material supply pipe and said annular gap.

8. A small diameter shield tunneling method using a set of three 120° arcuate segments to be assembled into a segment ring, comprising the repeated steps of:

providing a shield machine with a tail portion defined by a tail skin plate;

introducing into the tail portion of said shield machine a set of three 120° arcuate segments, and assembling within said tail portion said three segments to form a segment ring;

charging a back-filling material into an annular gap between the outer peripheral surface of said segment ring and natural soil surrounding the segment ring;

providing an annular seal device between the outer periphery of said segment ring and the inner periphery of said tail skin plate, said seal device being adapted to slidably move in the axial direction of the tunnel toward and away from a face where excavation of soil is to be carried out; and causing the annular seal device of said shield machine to move between the inner peripheral surface of said tail skin plate and the outer peripheral surface of said segment ring, in the axial direction of the tunnel away from said face, thereby to compress the back-filling material in said annular gap.

9. A small diameter shield tunneling method using a set of three 120° arcuate segments to be assembled into a segment ring, comprising the repeated steps of:

providing a shield machine with a tail portion defined by a tail skin plate;

introducing into the tail portion of said shield machine a set of three 120° arcuate segments, and assembling within said tail portion said three segments to form a segment ring;

providing an annular seal device between the outer periphery of said segment ring and the inner periphery of said tail skin plate, said seal device being adapted to slidably move in the axial direction of the tunnel toward and away from a face where excavation of soil is to be carried out;

further providing means for charging the back-filling material into said annular gap, including a cylinder which extends from inside of the shield machine through said annular seal device to open into said annular gap, and which is connected to a back-filling material supply pipe and a flushing water injection pipe, and further including a piston disposed within said cylinder and adapted to move between first and second positions;

charging a back-filling material into an annular gap between the outer peripheral surface of said segment ring and natural soil surrounding the segment ring, while maintaining said piston in said first position within said cylinder, with said cylinder in communication with said annular gap;

causing the annular seal device of said shield machine to move between the inner peripheral surface of said tail skin plate and the outer peripheral surface of said segment ring, in the axial direction of the tunnel away from said face, thereby to compress the back-filling material in said annular gap; and displacing said piston to said second position to bring said flushing water injection pipe into communication with said back-filling material supply pipe, while interrupting communication between said back-filling material supply pipe and said annular gap, and cleaning inside of said cylinder and said back-filling material supply pipe by said flushing water.

10. The small diameter shield tunneling method as claimed in claim 8 further comprising the step of: assembling a set of three 120° arcuate segments into a segment ring in that area within the tail portion of the shield machine which is axially remote from a radially inside area of said annular seal device.

11. The small diameter shield tunneling method as claimed in claim 9, further comprising the step of;

assembling a set of three 120° arcuate segments into a segment ring in that area within the tail portion of the shield machine which is axially remote from a radially inside are of said annular seal device.

* * * * *